US007662248B2

(12) United States Patent
Yamamoto et al.

(10) Patent No.: US 7,662,248 B2
(45) Date of Patent: Feb. 16, 2010

(54) PROCESS FOR PRODUCING A GAS GENERATING AGENT

(75) Inventors: Akio Yamamoto, Hyogo (JP); Takeshi Takahori, Hyogo (JP)

(73) Assignee: Daicel Chemical Industries, Ltd., Sakai-shi, Osaka (JP)

( * ) Notice: Subject to any disclaimer, the term of this patent is extended or adjusted under 35 U.S.C. 154(b) by 194 days.

(21) Appl. No.: 10/221,947

(22) PCT Filed: Mar. 27, 2001

(86) PCT No.: PCT/JP01/02477

§ 371 (c)(1),
(2), (4) Date: Sep. 18, 2002

(87) PCT Pub. No.: WO01/72666

PCT Pub. Date: Oct. 4, 2001

(65) Prior Publication Data

US 2003/0030162 A1 Feb. 13, 2003

(30) Foreign Application Priority Data

Mar. 28, 2000 (JP) ..... 2000-87839
Mar. 23, 2001 (JP) ..... 2001-84097

(51) Int. Cl.
*C06B 31/00* (2006.01)
*C06B 31/32* (2006.01)
*D03D 23/00* (2006.01)
*D03D 43/00* (2006.01)

(52) U.S. Cl. ..... 149/45; 149/47; 149/109.6

(58) Field of Classification Search ..... 149/45, 149/47, 109.6
See application file for complete search history.

(56) References Cited

U.S. PATENT DOCUMENTS

| | | | | | |
|---|---|---|---|---|---|
| 5,532,010 | A | * | 7/1996 | Spanier et al. | 426/94 |
| 5,608,183 | A | * | 3/1997 | Barnes et al. | 149/45 |
| 5,725,699 | A | * | 3/1998 | Hinshaw et al. | 149/19.1 |
| 5,735,118 | A | * | 4/1998 | Hinshaw et al. | 60/219 |
| 6,039,820 | A | * | 3/2000 | Hinshaw et al. | 149/45 |
| 6,059,906 | A | * | 5/2000 | Fleming et al. | 149/19.92 |
| 6,170,399 | B1 | * | 1/2001 | Nielson et al. | 102/336 |
| 6,241,281 | B1 | * | 6/2001 | Hinshaw et al. | 280/741 |

FOREIGN PATENT DOCUMENTS

| | | | |
|---|---|---|---|
| EP | 0 458 443 | A | 11/1991 |
| EP | 0 820 971 | B | 1/1998 |
| EP | 0 949 225 | A | 10/1999 |
| EP | 1 061 057 | A | 12/2000 |
| EP | 1 118 512 | A | 7/2001 |
| JP | 9-110574 | A | 4/1997 |
| JP | 10-87390 | A | 4/1998 |
| JP | 11-310490 | A | 11/1999 |
| JP | 2000-95592 | A | 4/2000 |
| JP | 2000-103692 | A | 4/2000 |
| WO | 00/44690 | | 8/2000 |
| WO | 01/04074 | A | 1/2001 |

* cited by examiner

*Primary Examiner*—Jerry Lorengo
*Assistant Examiner*—James E McDonough
(74) *Attorney, Agent, or Firm*—Birch, Stewart, Kolasch & Birch, LLP

(57) ABSTRACT

The present invention provides a process for producing a gas generating agent capable of constantly producing a gas generating agent with a high quality.

The process for producing a gas generating agent comprises the first step of feeding nitroguanidine, a basic copper nitrate and guar gum and stirring and mixing them in the presence of moisture, the second step of extrusion-molding and cutting the mixture, and the third step of drying it.

25 Claims, No Drawings

PROCESS FOR PRODUCING A GAS GENERATING AGENT

This application is the national phase under 35 U.S.C. § 371 of PCT International Application No. PCT/JP01/02477 which has an International filing date of Mar. 27, 2001, which designated the United States of America.

TECHNICAL FIELD TO WHICH THE INVENTION BELONGS

The present invention relates to a process for producing a gas generating agent particularly suitable for use in inflators for airbags installed in vehicles.

PRIOR ART

Known inflators in an inflatable type safety system (airbag system) for automobiles include a pyrotechnic inflator expanding an airbag only with a gas generated by combustion of a gas generating agent, a hybrid inflator expanding an airbag by pushing out a pressurized gas charged previously with a heat and pressure generated by combustion of a gas generating agent, and further, an inflator using the both in combination.

The gas generating agent used in these inflators is demanded to have various properties such that toxic components in a gas generated by combustion is restricted to be minimum, that good thermal stability is maintained with a passage of time, and that generation of mists is restricted to be minimum, etc., which are influenced by the composition of the starting components. Accordingly, in production of the gas generating agent, it is important to consistently provide the article having these properties, and it will be more desirable if the production process can also contribute to these properties.

U.S. Pat. Nos. 5,487,851 and 5,565,150 are known as relevant prior arts, but use of organic solvents is essential for inventions described in these patent specifications. Therefore, there is a problem in safety because the possibility of occurrence of fires cannot be eliminated, and there is also a problem with recovery of organic solvents and deterioration in the working atmosphere. In addition, U.S. Pat. No. 5,670,098 discloses a method of producing black powder.

DISCLOSURE OF INVENTION

An object of the invention is to provide a process for producing a gas generating agent which can reliably and stably exhibit properties required of its starting composition.

The other object of the invention is to provide a gas generating agent obtained by a specific process.

The present invention provides a process for producing a gas generating agent, comprising the first step of feeding two or more starting components containing fuel and an oxidizing agent and stirring and mixing them in the presence of moisture, the second step of extrusion-molding the mixture and cutting it, and the third step of drying it.

Further, the present invention provides a process for producing a gas generating agent comprising two or more starting components containing fuel and an oxidizing agent, which comprises the step of kneading and mixing the starting components in the presence of moisture by a screwed twin-shaft extruder.

A composition of the starting components to which the process of the invention is applied is not particularly limited. It is preferable that the fuel is a guanidine derivative and the oxidizing agent is a basic metal nitrate and further an additive is included as two or more starting components. It is more preferable that the composition of the starting components contains nitroguanidine, a basic copper nitrate and guar gum.

The process of the present invention can also be applied to either of a batchwise system in which a plurality of steps are conducted in different procedures, or a continuous system in which a plurality of steps from the step of mixing the starting components up to the step of molding and cutting the article are conducted in a single procedure.

Further, the present invention provides a gas generating agent obtained by feeding two or more components containing fuel and an oxidizing agent and mixing and molding them in the presence of a solvent, said gas generating agent having one, two or three requirements selected from the following requirements (x), (y) and (z):

(x) a shape of the molded article is in the form of a single-perforated cylinder or a perforated (porous) cylinder, (y) a reduced mass ratio of the molded article after being maintained at 110° C. for 400 hours is 1% or less, and (z) a mass reduction by heating of the molded article is not more than 0.7% by weight.

In the present invention, the "moisture" means the sum of a moisture initially present in the two or more starting components and a moisture fed to the starting components.

The "mass reduction by heating" means the reduced mass of a molded article of the gas generating agent after being kept at 120° C. for 120 minutes when a moisture is used as the solvent, and this reduced mass ratio essentially means a reduction in the moisture, which is determined by a halogen moisture meter. When an organic solvent other than moisture is used as the solvent, the boiling point of the organic solvent should be taken into consideration, and simultaneously the temperature and time achieving the desired mass reduction by heating are determined such that the finally obtained gas generating agent can satisfy qualities required of the article.

According to the process of the present invention, there can be constantly provided a high-quality gas generating agent.

PREFERRED EMBODIMENT OF THE INVENTION

The process for producing the gas generating agent of the present invention comprises the first, second and third steps described above, and a procedure ordinarily carried out in producing a gas generating agent by those skilled in the art can be additionally carried out before and after each of the steps described above. Unless otherwise specified, each step described below can be applied to both batch and continuous systems.

The first step is the step of feeding two or more starting components containing fuel and an oxidizing agent and stirring and mixing them in the presence of moisture. In the treatment in the first step, any of the following methods can be suitably selected as the method of feeding two or more starting components and moisture.

(i) A method in which each of the two or more starting components are fed with a necessary amount of moisture and then mixed.

(ii) A method in which two or more starting components and a necessary amount of moisture are simultaneously fed and then mixed.

(iii) A method in which two or more starting components are mixed and simultaneously fed with a necessary amount of moisture.

(iv) A method in which two or more starting components are preliminarily mixed, then fed with a necessary amount of moisture, and further mixed.

(v) A method in which, in the methods (i) to (iv), a necessary amount of water is fed by spraying.

In the first step, an aqueous solution, water, water vapor, and mixture of two or three thereof can be used as the moisture to be fed. The aqueous solution is an aqueous solution of a soluble component in the two or more starting components, for example an aqueous solution of a water-soluble binder.

The aqueous solution, water and water vapor are preferably those having an electrical conductance of not higher than 2 μS/cm wherein metal ions, for example alkali metal ions such as Na, K, Li, etc., alkaline earth metal ions such as Mg, Ca, etc., and other metal ions are reduced, more preferably ion-exchanged water and/or distilled water. Water, etc. not containing metal ions as described above are used for the following reason; for example, when moisture contains Na ions as metal ions, the Na ion can form NaOH which can remain in the gas generating agent to cause decomposition of the starting components such as fuel, etc. by hydrolysis reaction, which may result in a deterioration in the thermal stability of the gas generating agent itself.

An amount of moisture added in the first step is determined in consideration of an amount of the moisture contained initially in the starting components used, and, preferably, an amount of moisture in the mixture of the starting components at the time of mixing is adjusted to 5 to 60% by weight. When the batch system is employed, preferably, an amount of moisture is 30 to 60% by weight, more preferably 30 to 40% by weight. When the continuous system is employed, preferably, an amount of moisture is 10 to 30% by weight, more preferably 10 to 20% by weight.

When an amount of moisture at the time of mixing is lower than the upper limit, the adjustment of moisture can be facilitated and simultaneously productivity can also be improved. When an amount of moisture is higher than the lower limit, the mixing operation can be carried out smoothly and a preferable binder effect can be given, thus facilitating the molding procedure and preventing cracking of the molded article or significant roughness of the surface of the molded article.

Conditions of mixing two or more starting components with moisture in the first step are that a mixing temperature is preferably 20 to 100° C., more preferably 40 to 80° C., and a mixing time is preferably 10 to 120 minutes, more preferably 30 to 60 minutes in the batch system, or preferably 1 to 10 minutes in the continuous system.

When the process of the invention is carried out in the batch system, part of the moisture can be removed by volatilization while the components are mixed, and after the components are mixed, part of the moisture can also be removed by volatilization.

At the time of removing part of moisture by volatilization, the moisture can be removed by volatilization at a higher temperature by preferably 0 to 80° C., more preferably 10 to 30° C. Further, in case of removing part of moisture by means of volatilization to facilitate treatments in later steps, an amount of the moisture in the mixture of the starting components is adjusted to preferably 5 to 30% by weight, more preferably 10 to 30% by weight, still more preferably 10 to 20% by weight.

When two or more materials and moisture are mixed in a mixer in the first step, a method of degassing through a vent hole of the mixer, if required, under suction can be used as a method of removing part of the moisture.

When the process of the invention is carried out in the batch system, cooling treatment can be additionally carried out to facilitate handling in the post-step (aging treatment) after part of the moisture is removed by volatilization under mixing as described above. In this cooling treatment, a temperature of the mixture is reduced to preferably 30 to 65° C., more preferably 30 to 50° C. after cooling.

The cooling method is not particularly limited, but when two or more starting components and moisture are mixed in a mixer in the first step, such a method can be employed that reverse rotation and forward rotation of stirring are suitably combined. When one stirrer is used, the "reverse rotation" or "forward rotation" means that the stirring direction (rotating direction) is made different. And when two stirrers are used, the "reverse rotation" means that one (e.g. the left stirrer) of the two adjacent stirrers is rotated in the clockwise direction and the other (the right stirrer) is rotated in the anticlockwise direction, while the "forward rotation" means that the left stirrer is rotated in the anticlockwise direction and the right stirrer is rotated in the clockwise direction.

When the process of the invention is carried out in the batch system, a step of aging the mixture can be additionally carried out between the first and second steps, in order not to make uneven parts in temperature and moisture of the mixture and further, in order to regulate the temperature so as to facilitate extrusion molding.

The aging treatment is carried out by keeping the mixture preferably at 30 to 50° C., more preferably at 35 to 45° C. and preferably for 8 hours or more, more preferably 16 hours or more.

The aging treatment can be carried out in the mixing machine used in the first step or it can be carried out after transferring the mixture to another container which is capable of maintaining the mixture under predetermined conditions.

The second step is a step of extrusion-molding and cutting the mixture obtained in the first step from two or more starting components and moisture. When the batch system is employed, the mixture after the first step or the subsequent aging step is extrusion-molded by an extruder.

Extrusion-molding is not particularly limited, and a method of molding at one stage or a method of molding at two or more divided stages including pre-molding can be used. In case of one-stage molding, a molding pressure is preferably 70 MPa or less, more preferably 60 MPa or less. And in case of two-stage molding, a pre-molding pressure is preferably 70 MPa or less, more preferably 60 MPa or less, and further, a molding pressure is preferably 70 MPa or less, more preferably 60 MPa or less.

In the first step, an amount of moisture in the mixture of the starting components before extrusion-molding is preferably adjusted to 5 to 30% by weight, more preferably 10 to 30% by weight, still more preferably 10 to 20% by weight. When an amount of moisture in the mixture of the starting components at extrusion-molding is less than 5% by weight, additional moisture is desirably added to adjust an amount of moisture to the above range.

When an amount of moisture at extrusion-molding is less than the upper limit, a molding procedure is made easy and a molded article is not deformed. When an amount of moisture is higher than the lower limit, a preferable binder effect can be given, thus facilitating a molding procedure and preventing cracking of a molded article or significant roughness of the surface of a molded article.

In a cutting procedure, the article is cut into pieces to meet required standards by a cutting machine or a cutting machine connected to the extrusion-molding machine.

The third step is a step of drying the molded article which is extrusion-molded and cut in the second step. In the batch and the continuous system, the drying treatment is carried out in a drying oven.

The drying treatment is carried out such that an amount of moisture in the gas generating agent is reduced to be preferably 0.5% by weight or less, more preferably 0.3% by weight or less.

The drying method is not particularly limited, and a method of drying at one stage or a method of drying at two or more divided stages including pre-drying can be employed. Preferably, one-stage drying is carried out at a temperature of 80 to 120° C., more preferably 90 to 110° C. And in case of two-stage drying, pre-drying is carried out preferably at 20 to 40° C., more preferably at 25 to 35° C., and then, drying is carried out preferably at 80 to 120° C., more preferably at 90 to 110° C.

The classification step of regulating the size of the gas generating agent can be additionally carried out after the third step by sifting the gas generating agent.

The treatment in the above-described steps in the process of the invention can be carried out, for example, by a combination of a mixer, a container for aging, an extruder, a cutting machine and a drying oven in case of the batch system, and by a combination of a twin-screw kneading and mixing extruder, a cutting machine (pelletizer) and a drying oven in the case of the continuous system.

When the continuous system is employed, it is preferable to use a twin-screw extruder in the first step (kneading and mixing step).

When the screwed twin-shaft extruder is used in the kneading and mixing step, a desired die can be attached to an extrusion orifice of the screwed twin-shaft extruder, and by changing a shape of the die hole, a molded article of desired shape in the form of a pellet, a single-perforated cylinder or a perforated (porous) cylinder can be obtained. For example, in order to obtain a molded article in the form of a single-perforated or perforated (porous) cylinder, a die consisting of a combination of a pin and a bushing is used.

After the article is thus molded in the kneading and mixing step, the molded article can be subjected to cutting at the outlet of the die in the subsequent step linked with extrusion-molding, or once formed into a plurality of molded articles in a stand form and then subjected to cutting.

When a screwed twin-shaft extruder is used, an amount of moisture in the mixture in the starting components inside the extruder is preferably 5 to 60% by weight, more preferably 10 to 30% by weight, still more preferably 10 to 20% by weight. For the same reason as in the preferable range of an amount of the moisture at extrusion-molding, moisture in the extruder is regulated by degassing through a vent hole and the like so that an amount of moisture in the die attached to the extruder is reduced to be preferably 5 to 30% by weight, more preferably 10 to 30% by weight, still more preferably 10 to 20% by weight.

In the process of the invention, it is possible to use (a) fuel and (b) an oxidizing agent and (c) an additive if required as the two or more starting components. In this case, the content of the starting components in the following description is shown on a dry-weight basis.

As the fuel as component (a), a nitrogen-containing compound which is generally used as fuel in a gas generating agent can be used. The nitrogen-containing compound can include one or at least two selected from the group consisting of tetrazole derivatives such as 5-aminotetrazole and the like, bitetrazole derivatives such as bitetrazole diammonium salt and the like, triazole derivatives such as 4-aminotriazole and the like, guanidine derivatives such as dicyandiamide, nitroguanidine, guanidine nitrate and the like, triazine derivatives such as trihydrazinotriazine and the like, oxamide, ammonium oxalate, azodicarbonamide, hydrazodicarbonamide and the like.

The guanidine derivatives can include at least one selected from the group consisting of guanidine, mono-, di- and triaminoguanidine nitrates, guanidine nitrate, guanidine carbonate, nitroguanidine (NQ), dicyandiamide (DCDA) and nitroaminoguanidine nitrate, and among these, nitroguanidine and dicyandiamide are preferable.

The oxidizing agent used as the component (b) can be one or at least two selected from the group consisting of nitrates such as basic metal nitrates, alkali metal nitrates and alkaline earth metal nitrates such as strontium nitrate, oxygen acid salt, metal oxides, metal complex oxides, metal hydroxides and metal peroxides.

The basic metal nitrates are a series of compounds represented by the formula below. Some compounds contain hydrates thereof, too.

$$M(NO_3)_{y'}{}^{-}nM(OH)_{z'} \text{ or } M_{x'}, (NO_3)_{y'}, (OH)_{z'}.$$

wherein M represents a metal, x' represents the number of metals, y and y' each represent the number of $NO_3$ ions, z' represents the number of OH ions, and n represents a ratio of $M(OH)_{z'}$ moiety to $M(NO_3)_{y'}$ moiety.

Examples of the compound corresponding to the above formula includes one or at least two selected from the group consisting of basic copper nitrates [(BCN) $Cu_2(NO_3)(OH)_3$, $Cu_3(NO_3)(OH)_5{}^{-}2H_2O$], basic cobalt nitrate [$Co_2(NO_3)(OH)_3$], basic zinc nitrate [$Zn_2(NO_3)(OH)_3$], basic manganese nitrate [$Mn(NO_3)(OH)_2$], basic iron nitrate [$Fe_4(NO_3)(OH)_{11}{}^{-}2H_2O$], basic molybdenum nitrate, basic bismuth nitrate [$Bi(NO_3)(OH)_2$] and basic cerium nitrate [$Ce(NO_3)_3(OH)^{-}3H_2O$] containing copper, cobalt, zinc, manganese, iron, molybdenum, bismuth or cerium as a metal M, and among these, a basic copper nitrate is preferable.

The basic copper nitrate has, in comparison with ammonium nitrate as an oxidizing agent, an excellent thermal stability because no phase transition occurs in the range of the use temperature and a melting point is high. Further, since the basic copper nitrate acts to decrease a combustion temperature of a gas generating agent, amounts of nitrogen oxides generated can be decreased.

The oxy acid salt includes nitrates, nitrites, chlorates and perchlorates of ammonium, alkali metal, alkaline earth metal, alkaline earth metal complex, transition metal or transition metal complex.

The metal oxides, metal complex oxides and metal hydroxides include oxides, complexes or hydroxides of copper, cobalt, iron, manganese, nickel, zinc, molybdenum or bismuth.

The metal peroxides include peroxides of magnesium, calcium or strontium, for example $MgO_2$, $CaO_2$, $SrO_2$, etc.

When the gas generating agent comprises (a) fuel and (b) an oxidizing agent, a content of the component (a) is preferably 5 to 60% by weight, more preferably 15 to 55% by weight. A content of the component (b) is preferably 40 to 95% by weight, more preferably 45 to 85% by weight.

One preferable embodiment in case of including the components (a) and (b) includes one comprising (a) biterazole diammonium salt and (b) a basic copper nitrate. In this case, contents are preferably 5 to 60% by weight, preferably 15 to 55% by weight, more preferably 15 to 45% by weight or 15 to 35% by weight of (a) bitetrazole diammonium salt, and 40 to 95% by weight, preferably 45 to 85% by weight and more preferably 55 to 85% by weight or 65 to 85% by weight of (b) a basic copper nitrate.

Other preferable embodiment of the gas generating agent including the components (a) and (b) can be one comprising (a) nitroguanidine and (b) a basic copper nitrate. In this case, contents are preferably 30 to 70% by weight, preferably 40 to 60% by weight of (a) nitroguanidine, and 30 to 70% by weight, preferably 40 to 60% by weight of (b) a basic copper nitrate.

Still other preferable embodiment of the gas generating agent inclusing the components (a) and (b) can be one comprising (a) dicyandiamide and (b) a basic copper nitrate. In this case, contents are preferably 15 to 30% by weight of (a) dicyandiamide and 70 to 85% by weight of (b) a basic copper nitrate.

As the additive as component (C), at least one selected from the group consisting of carboxymethyl cellulose (CMC), carboxymethyl cellulose sodium salt (CMCNa), carboxymethyl cellulose potassium salt, carboxymethyl cellulose ammonium salt, acetate cellulose, cellulose acetate butyrate (CAB), methyl cellulose (MC), ethyl cellulose (EC), hydroxyethyl cellulose (HEC), ethyl hydroxyethyl cellulose (EHEC), hydroxypropyl cellulose (HPC), carboxymethyl ethyl cellulose (CMEC), fine crystalline cellulose, polyacrylamide, aminated polyacrylamide amide, polyacryl hydrazide, acrylamide-metal acrylate copolymers, copolymer of polyacrylamide and polyacrylate ester compound, polyvinyl alcohol, acrylic rubber, guar gum, starch, silicone, molybdenum disulfide, Japanese acid clay, talc, bentonite, diatomaceous earth, kaolin, calcium stearate, silica, alumina, sodium silicate, silicon nitride, silicon carbide, hydrotalcite, mica, nitrates ($KNO_3$, $NaNO_3$, etc.), perchlorates ($KClO_4$, etc.), metal oxides, metal hydroxides, metal carboxylates, basic metal carbonates and molybdates can be proposed.

As the metal oxide, at least one selected from the group consisting of copper oxide, iron oxide, zinc oxide, cobalt oxide, manganese oxide, molybdenum oxide, nickel oxide and bismuth oxide can be proposed. As the metal hydroxide, at least one selected from the group consisting of cobalt hydroxide and aluminum hydroxide can be proposed. As the metal carboxylate or basic metal carboxylate, at least one selected from the group consisting of calcium carbonate, cobalt carbonate, basic zinc carboxylate, basic copper carbonate, basic cobalt carbonate, basic iron carbonate, basic bismuth carbonate and basic magnesium carbonate can be proposed. As the molybdate, at least one selected from the group consisting of cobalt molybdate and ammonium molybdate can be proposed. These compounds can act as slag-forming agents and/or binders. The binder in the form of aqueous solution in 1% by weight preferably has a viscosity of 100 to 10,000 mPas.

To improve the ignitability of the gas generating agent, the carboxymethyl cellulose sodium salt and potassium salt are preferable, and the sodium salt is more preferable.

When the gas generating agent includes the components (a) (b) and (c), a content of the component (a) is preferably 5 to 60% by weight, more preferably 15 to 55% by weight. A content of the component (b) is preferably 40 to 95% by weight, more preferably 45 to 85% by weight. A content of the component (c) is preferably 0.1 to 25% by weight, more preferably 0.1 to 15% by weight, still more preferably 0.1 to 10% by weight.

A preferable embodiment of the gas generating agent including the components (a), (b) and (c) can be one comprising (a) nitroguanidine, (b) a basic copper nitrate and (c) carboxymethyl cellulose sodium salt. In this case, contents are preferably 15 to 55% by weight of (a) nitroguanidine, 45 to 70% by weight of (b) a basic copper nitrate and 0.1 to 15% by weight of (c) carboxymethyl cellulose sodium salt.

Other preferable embodiment of the gas generating agent including the components (a), (b) and (c) can be one comprising (a) nitroguanidine, (b) a basic copper nitrate and (c) guar gum. In this case, contents are preferably 20 to 60% by weight, more preferably 30 to 50% by weight of (a) nitroguanidine, preferably 35 to 75% by weight, more preferably 40 to 65% by weight of (b) a basic copper nitrate, and preferably 0.1 to 10% by weight, more preferably 1 to 8% by weight of (c) guar gum.

Still other preferable embodiment of the gas generating agent including the components (a), (b) and (c) can be one comprising (a) nitroguanidine, (b) a basic copper nitrate, (c-1) guar gum and (c-2) a component (c) other than (c-1). In this case, contents are preferably 20 to 60% by weight, more preferably 30 to 50% by weight of (a) nitroguanidine, preferably 30 to 70% by weight, more preferably 40 to 60% by weight of (b) a basic copper nitrate, preferably 0.1 to 10% by weight, more preferably 2 to 8% by weight of (c-1) guar gum, and preferably 0.1 to 10, more preferably 0.3 to 7% by weight of (c-2).

Still other preferable embodiment of the gas generating agent including the components (a), (b) and (c) can be one comprising (a) nitroguanidine, (b) a basic copper nitrate, (c-1) carboxymethyl cellulose sodium salt, (c-2) a component (c) other than (c-1). In this case, contents are preferably 15 to 50% by weight of (a) nitroguanidine, preferably 30 to 65% by weight of (b) a basic copper nitrate, preferably 0.1 to 15% by weight of (c-1) carboxymethyl cellulose sodium salt, and 1 to 40% by weight of (c-2).

Still other preferable embodiment of the gas generating agent including the components (a), (b) and (c) can be one comprising (a) dicyandiamide, (b) a basic copper nitrate and (c) carboxymethyl cellulose sodium salt. In this case, contents are preferably 15 to 25% by weight of (a) dicyandiamide, preferably 60 to 80% by weight of (b) a basic copper nitrate, and preferably 0.1 to 20% by weight of (c) carboxymethyl cellulose sodium salt.

Still other preferable embodiment of the gas generating agent including the components (a), (b) and (c) can be one comprising (a) dicyandiamide, (b) a basic copper nitrate, (c-1) carboxymethyl cellulose sodium salt, and (c-2) a component (c) other than (c-1). In this case, contents are preferably 15 to 25% by weight of (a) dicyandiamide, preferably 55 to 75% by weight of (b) a basic copper nitrate, preferably 0 to 10% by weight or 0.1 to 10% by weight of (c-1) carboxymethyl cellulose sodium salt, and 1 to 20% by weight of (c-2).

Still other preferable embodiment of the gas generating agent including the components (a), (b) and (c) can be one comprising (a) nitroguanidine, (b) strontium nitrate, (c-1) carboxymethyl cellulose sodium salt and (c-2) Japanese acid clay.

In the process of the invention, a combustion regulator (combustion improving agent) can be incorporated into the two or more starting components. The combustion improving agent is a component acting to improve combustion properties such as burning rate, duration of combustion, ignitability, etc. of the gas generating agent as a whole. As the combustion improving agent, at least one selected from the group consisting of silicon nitride, alkali metal or alkaline earth metal nitrites, nitrates, hydrochlorides or perchlorates ($KNO_3$, $NaNO_3$, $KClO_4$, etc.), iron (III) oxide hydroxide [FeO(OH)], copper oxide, iron oxide, zinc oxide, cobalt oxide and manganese oxide can be proposed. Among these, when iron (III) oxide hydroxide [FeO(OH)] is used, combustion of the binder containing a large number of carbon atoms is improved excellently, thereby improving combustion of the gas generating agent as a whole.

An amount of the combustion improving agent blended is preferably 1 to 10 parts by weight, more preferably 1 to 5 parts by weight to the total (100 parts by weight) of the components (a) and (b) or the components (a), (b) and (c).

In the process of the invention, the gas generating agent can be molded in a desired shape, for example in the form of a single-perforated cylinder, a perforated (porous) cylinder, or a pellet.

The gas generating agent obtained in the process of the invention desirably satisfies one, two or three requirements selected from the following requirements (x), (y) and (z):

(x) A shape of the molded article is in the form of a single-perforated cylinder or a perforated (porous) cylinder. By satisfying the requirement (x), the combustion area can be increased, so that combustion performance can be imporved;

(y) A reduced mass ratio of the molded article after being kept at 110° C. for 400 hours is 1% or less, preferably 0.6% or less. By satisfying the requirement (y), thermal stability can be improved, so that the stable combustion performance can be maintained for a prolonged period of time; and (z) The mass reduction by heating of the molded article is 0.7% by weight or less, preferably 0.5% by weight or less, more preferably 0.3% by weight or less. By satisfying the requirement (z), the strength of the molded article can be maintained, so that the stable combustion performance can be maintained for a prolonged period of time.

When the moisture at the time of production of the gas generating agent is replaced by an equal volume of an organic solvent, for example, alcohols such as isopropanol, butanol, etc., esters such as ethyl acetate, etc., ethers such as isopropyl ethers, or ketones such as acetone, methyl ethyl ketone, etc., the mass reduction by heating of the molded article in the requirement (z) is 0.7% by weight or less, preferably 0.5% by weight or less, more preferably 0.3% by weight.

The gas generating agent obtained in the process of the invention can be applied to, for example, an air bag inflator for a driver side, an air bag inflator for a passenger side, an air bag inflator for a side collision, an inflator for an inflatable curtain, an inflator for a knee-bolster, an inflator for an inflatable seat belt, an inflator for a tubular system and an inflator for a pretensioner in various vehicles.

The gas generating agent obtained in the process of the invention can be used not only as the gas generating agent for inflators but also as an igniting agent called an enhancer (or booster) for transmitting the energy of a detonator or a squib to the gas generating agent.

EXAMPLES

Hereinafter, the present invention is described in more detail by reference to the examples, however, the present invention is not limited to these only.

Example 1

Batch System

As the starting components, 27.6% by weight of nitroguanidine, 33.0% by weight of a basic copper nitrate, 1.9% by weight of guar gum and 37.5% by weight of ion-exchanged water (electrical conductance, 1 μS/cm) were introduced into a kneader and mixed at the temperature of 70° C. for 30 minutes.

After the starting components were mixed, the temperature inside the kneader was maintained at 80° C. for 8 hours, and water vapor was removed by volatilization through a vent hole of the kneader. The content of moisture in the mixture was 15.5% by weight. Thereafter, the temperature of the mixture was reduced to 45° C. under stirring in the kneader. Then, the mixture was removed from the kneader, transferred to an aging unit capable of regulating temperature, and aged for 8 hours at the temperature of at 40° C.

After aging, the mixture was fed to an extruder and molded at the molding pressure of 63 MPa to give a single-perforated strand. This strand was fed to a cutting machine and cut to give a single-perforated, cylindrical gas generating agent (having the outer diameter of 2.4 mm, the inner diameter of 0.7 mm, and the length of 4.0 mm).

Thereafter, the gas generating agent was placed in a drying oven, pre-dried at the temperature of 30° C. and further dried at 80° C. until the mass reduction by heating became 0.3% by weight or less, followed by sifting to give a final product.

The reduced mass ratio of the obtained gas generating agent after 400 hours was 0.4% by weight, which was determined in the thermal stability test described below. A lower reduced mass ratio indicates higher thermal stability, that is, decomposition hardly occurs even for a prolonged period of time (for example, for over 10 years).

Thermal Stability Test 40 g of a gas generating agent was placed into an aluminum container, a total weight thereof was measured, and (total weight−weight of the aluminum container) was assumed to be the weight of the sample before the test. The aluminum container containing the sample was placed in an SUS thick container (having the internal volume of 118.8 ml), covered with a lid, and placed in a thermostat bath at 110° C. The container had been in a closed state by means of a rubber packing and a clamp. After a predetermined time passed, the SUS thick container was removed from the thermostat bath, and when the container was returned to room temperature, the container was opened, and the aluminum container was removed therefrom. The total weight of the sample inclusive of the aluminum container was measured, and (total weight−weight of the aluminum container) was regarded as the weight of the sample after the test. The thermal stability was evaluated by determining the reduced mass ratio by comparing the change in the weight before and after the test. The reduced mass ratio was obtained from [(weight of the gas generating agent before the test−weight of the gas generating agent after the test)/weight of the gas generating agent before the test]×100.

Example 2

Continuous System 36.8% by weight of nitroguanidine, 44.0% by weight of the basic copper nitrate, 2.5% by weight of guar gum and 16.7% by weight of ion-exchanged water (electrical conductance 1 μS/cm) were introduced through a raw-material inlet of a screwed twin-shaft extruder, and kneaded. Kneading was conducted at the temperature of 80° C. for the kneading time (retention time) of 2 minutes. Thereafter, the mixture was extrusion-molded and cut to give a single-perforated gas generating agent (having the outer diameter of 2.4 mm, the inner diameter of 0.7 mm, and the length of 4.0 mm). Then, the gas generating agent was introduced into a drying oven, pre-dried at the temperature of 30° C. and further dried at 80° C. until the mass reduction by heating became 0.3% by weight or less, followed by sifting to give a final product. The reduced mass ratio of the gas generating agent after 400 hours was 0.45% by weight.

Example 3

Continuous System

A single-perforated cylindrical gas generating agent (having the outer diameter of 2.4 mm, the inner diameter of 0.7 mm and the length of 4.0 mm) was produced in the same manner as in Example 2 using of a twin-screw extruder in which a die for giving a single-perforated cylindrical molded article was attached to the extrusion orifice. The mass reduction by heating of the gas generating agent was 0.3% by weight or less, and the reduced mass ratio thereof after 400 hours was 0.45% by weight.

The invention claimed is:

1. A process for producing a gas generating agent, which comprises the following sequential steps:

(a.) feeding at least two starting components including a nitrogen-containing compound fuel and basic copper nitrate oxidizing agent and stirring and mixing them in the presence of 10 to 60% by weight moisture which has an electrical conductance of not higher than 2 μS/cm and which is in the form of an aqueous solution, water, or water vapor to form a mixture, (b.) aging the mixture by heating it at a temperature of 35 to 50° C. for 8 hours or more so that an amount of moisture in the mixture of the starting compounds at the time of being transferred to the extrusion-molding step which follows is 10 to 20% by weight, (c.) extrusion-molding the mixture and cutting it, and (d.) drying it by a two-stage drying process which comprises placing it in a drying oven, then carrying out pre-drying at 20 to 40° C. and subsequently carrying out drying at 80 to 120° C., whereby an amount of moisture in the gas generating agent is reduced to 0.5% by weight or less.

2. The process for producing a gas generating agent according to claim 1, wherein, in the first step, each of the at least two starting components are fed with moisture and then mixed.

3. The process for producing a gas generating agent according to claim 1, wherein, in the first step, the at least two starting components and moisture are simultaneously fed and then mixed.

4. The process for producing a gas generating agent according to claim 1, wherein, in the first step, the at least two starting components are mixed and simultaneously fed with moisture.

5. The process for producing a gas generating agent according to claim 1, wherein, in the first step, the at least two starting components are preliminarily mixed, then fed with moisture, and further mixed.

6. The process for producing a gas generating agent according to claim 1, wherein the moisture is fed by spraying.

7. The process for producing a gas generating agent according to claim 1, wherein the moisture is ion-exchanged water and/or distilled water.

8. The process for producing a gas generating agent according to claim 1, wherein the mixing conditions in the first step are the temperatures of 20 to 100° C. and the time of 10 to 120 minutes.

9. The process for producing a gas generating agent according to claim 1, wherein the mixing conditions in the first step are the temperatures of 20 to 100° C. and the time of 1 to 10 minutes.

10. The process for producing a gas generating agent according to claim 1, wherein, in the first step, the moisture is partially removed by volatilization while mixing.

11. The process for producing a gas generating agent according to claim 1, wherein, in the first step, the moisture is partially removed by volatilization after mixing.

12. The process for producing a gas generating agent according to claim 11, wherein the moisture is removed by volatilization at a higher temperature by 0 to 80° C. than the temperature at the time of mixing.

13. The process for producing a gas generating agent according to claim 10, 11 or 12, wherein, in the first step, the moisture is removed by volatilization so that an amount of moisture in the mixture of the starting components is reduced to 5 to 30% by weight.

14. The process for producing a gas generating agent according to claim 1, wherein, in the first step, the moisture is partially removed by volatilization while mixing, and then cooling treatment is performed.

15. The process for producing a gas generating agent according to claim 14, wherein the temperature of the mixture after cooling treatment is 30 to 65° C.

16. The process for producing a gas generating agent according to claim 14 or 15, wherein the stirring rotation at the time of the cooling treatment is reversed and/or forwarded.

17. The process for producing a gas generating agent according to claim 1, wherein, at the time of extrusion molding in the second step, the mixture is pre-molded at the molding pressure of 70 MPa or less and then molded at the molding pressure of 70 MPa or less.

18. The process for producing a gas generating agent according to claim 1, which further includes classification treatment after the drying step.

19. The process for producing a gas generating agent according to claim 1, wherein the nitrogen-containing compound is a guanidine derivative.

20. The process for producing a gas generating agent according to claim 1, wherein an additive is further included as the at least two starting components.

21. The process for producing a gas generating agent according to claim 20, wherein the additive is a binder and/or a slag-forming agent.

22. The process for producing a gas generating agent according to claim 21, wherein the viscosity of aqueous solution in 1% by weight of the binder is 100 to 10,000 mPas.

23. The process for producing a gas generating agent according to claim 21 or 22, wherein the additive is guar gum or carboxymethyl cellulose sodium salt.

24. The process for producing a gas generating agent according to claim 1, wherein, in the first step, an aqueous solution of the binder is fed as the moisture.

25. A process for producing a gas generating agent, which comprises the following sequential steps:

(a.) feeding at least two starting components including a nitroguanidine fuel and basic copper nitrate oxidizing agent and stirring and mixing them in the presence of 10 to 60% by weight moisture which has an electrical conductance of not higher than 2 μS/cm and which is in the form of an aqueous solution, water, or water vapor to form a mixture, (b.) aging the mixture by heating it at a temperature of 35 to 50° C. for 8 hours or more so that an amount of moisture in the mixture of the starting compounds at the time of being transferred to the extrusion-molding step which follows is 10 to 20% by weight, (c.) extrusion-molding the mixture and cutting it, and (d.) drying it by a two-stage drying process which comprises placing it in a drying oven, then carrying out pre-drying at 20 to 40° C. and subsequently carrying out drying at 80 to 120° C., whereby an amount of moisture in the gas generating agent is reduced to 0.5% by weight or less.

* * * * *

UNITED STATES PATENT AND TRADEMARK OFFICE

CERTIFICATE OF CORRECTION

PATENT NO. : 7,662,248 B2
APPLICATION NO. : 10/221947
DATED : February 16, 2010
INVENTOR(S) : Yamamoto et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 588 days.

Signed and Sealed this

Twenty-eighth Day of December, 2010

David J. Kappos

David J. Kappos
*Director of the United States Patent and Trademark Office*